US006343763B1

(12) United States Patent
Fleury et al.

(10) Patent No.: US 6,343,763 B1
(45) Date of Patent: Feb. 5, 2002

(54) TRANSFERRING WINDING FROM A FILLED CYLINDRICAL PACKAGE OF AN ELONGATE MATERIAL TO AN EMPTY CORE

(75) Inventors: Philip J. Fleury, St. Francis Xavier; Darrell Van Mol, Winipeg, both of (CA)

(73) Assignee: KT Equipment (International) Inc., St. Michael (BB)

( * ) Notice: Subject to any disclaimer, the term of this patent is extended or adjusted under 35 U.S.C. 154(b) by 0 days.

(21) Appl. No.: 09/621,863

(22) Filed: Jul. 21, 2000

(51) Int. Cl.[7] ..... B65H 18/08
(52) U.S. Cl. ..... 242/471; 242/474.5; 242/474.6
(58) Field of Search ..... 242/471, 474.4, 242/474.5, 474.6, 530.2, 530, 533.7

(56) References Cited

U.S. PATENT DOCUMENTS 1,638,074 A * 8/1927 Van Veen
5,016,434 A * 5/1991 Kamp
5,344,090 A * 9/1994 Nakai et al.
5,516,058 A * 5/1996 Omokawa et al.
6,149,097 A * 11/2000 Ludwig et al.
6,161,790 A * 12/2000 Westrich

* cited by examiner

*Primary Examiner*—William A. Rivera
(74) *Attorney, Agent, or Firm*—Adrian D. Battison; Michael E. Williams

(57) ABSTRACT

An apparatus for winding tape includes a cantilevered support arm for supporting in a winding position a core onto which the tape is to be wound with a surface drive roller pivotal to a position engaging the outside of the package for causing rotation of the package in the driving position about a longitudinal axis of the arm. A lay-on roller directs the tape on to the core such that the rotation of the core acts to wind the tape into the package. The lay-on roller is driven by a lead screw in movement longitudinally of the axis to form a generally cylindrical package structure of the tape. With the lay-on roller in a retracted position to one side, the finished package on the support arm is moved by a rotatable drive head rotating about a vertical axis from the winding position away from the drive roller to a doffing position and simultaneously an empty core is moved from the doffing position over the drive roller to the winding position. The apparatus includes four winding positions at the corners of a rectangular frame so that each package at each of the positions is moved simultaneously to the doffing position outside the frame for ready access by an operator.

25 Claims, 6 Drawing Sheets

TRANSFERRING WINDING FROM A FILLED CYLINDRICAL PACKAGE OF AN ELONGATE MATERIAL TO AN EMPTY CORE

BACKGROUND OF THE INVENTION

The present invention is particularly but not exclusively concerned with winding strip or tape material which has a width greater than its thickness so that the material has to be laid carefully onto the package structure to ensure stability of the finished package structure.

SUMMARY OF THE INVENTION

It is one object of the present invention, therefore, to provide an improved apparatus for winding elongate material.

According to a first aspect of the invention, therefore, there is provided an apparatus for winding an elongate material comprising:

- a support for supporting in a winding position a core onto which the material is to be wound;
- a drive assembly for causing rotation of the core in the driving position about a longitudinal core axis;
- a guide for directing the elongate material to the core such that the rotation of the core about the axis acts to wind the material around the core;
- a traverse drive for effecting relative movement longitudinally of the axis between the core and the guide such that the material is traversed longitudinally of the core as it is wound around the core to form a generally cylindrical package structure;
- and a rotatable drive head for transporting the package structure from the winding position to a doffing position and simultaneously for transporting an empty core from a supply position to the winding position, the rotatable drive head being arranged for rotation about a head axis substantially at right angles to the axis of the core.

Preferably the head axis is substantially vertical and the axis of the core is substantially horizontal.

Preferably the support is carried on the head and is cantilevered relative to the head from one end of core.

In some embodiments there is provided for the core a rotatable end support member movable along the core axis into engagement with the other end of the core for assisting in supporting the core during winding. This arrangement helps stabilize the package particularly where packages of larger diameter and weight are formed.

Preferably the head comprises a post and the support comprises a pair of hubs each connected to the post for carrying the package core and the empty core respectively.

Preferably the rotatable drive head is rotated through 180 degrees such that the doffing position and the supply position are the same position at which the package is removed and the empty core is replaced. However turning movement in steps less than the angle of 180 degrees may be provided for different stations around the axis of the head.

Preferably the drive assembly comprises a rotatable surface drive body, which is either a roller or a set of drive belts arranged to frictionally engage an outer surface of the package to effect driving of the package by surface drive. The drive belts arranged side by side around two parallel rollers can be used in replacement for a simple roller to increase friction to larger packages.

Preferably the surface drive roller or belts is mounted for movement relative to the core axis in a direction transverse to the core axis from an initial position to a retracted position to accommodate increasing diameter of the package on the core.

Preferably the surface drive roller or belts is mounted on a pivot arm arrangement for pivotal movement about an axis parallel to the core axis.

Preferably the surface drive roller is arranged in the retracted position such that the package moves on the drive head away from the surface drive body over the pivot axis and such that the empty core passes across the drive roller into the winding position.

Preferably the traverse drive drives the guide while the package itself remains at a stationary position along the core axis while it rotates.

Preferably the guide is a lay-on roller rotatable about an axis parallel to the core axis for contacting the package during winding.

Preferably the traverse drive drives the lay-on roller from a guide location during winding to a retracted position beyond one end of the package when the drive head moves the package such that the package moves past the normal location to the doffing position.

Preferably there is provided a length compensation system for taking up changes in path length of the material caused by movement of the guide and the length compensation system is positively driven in synchronism with and at a length proportional to movement of the guide.

Preferably the length compensation system includes a fixed guide member or roller over which the material passes and a movable guide member or roller over which the material passes, the movable guide roller being arranged to move away from and back toward the fixed guide roller to generate a change in path length, the distance of movement of the movable guide roller being one half of the movement of the lay-on roller.

Preferably the lay-on roller is driven in a direction parallel to the core axis by a first lead screw parallel to the core axis and wherein the movable guide roller of the length compensation system is driven by a second lead screw parallel to the first and driven commonly with the first.

Preferably the apparatus includes a winding module having four winding positions lying in a common horizontal plane and wherein each winding position is arranged at a corner of the module such that the doffing position of each winding position is located outside the module beyond the respective corner.

Preferably there is provided two rows of the winding positions making eight in total.

According to a second aspect of the invention there is provided an apparatus for winding an elongate material comprising:

- a support for supporting in a winding position a core onto which the material is to be wound;
- a drive assembly for causing rotation of the core in the driving position about a longitudinal core axis;
- a guide for directing the elongate material to the core such that the rotation of the core about the axis acts to wind the material around the core;
- a traverse drive for effecting movement longitudinally of the axis of the guide such that the material is traversed longitudinally of the core as it is wound around the core to form a generally cylindrical package structure;
- and a length compensation system for taking up changes in path length of the material caused by movement of the guide;
- wherein the length compensation system is positively driven in synchronism with and at a length proportional to movement of the guide.

BRIEF DESCRIPTION OF THE DRAWINGS

Embodiments of the invention will now be described in conjunction with the accompanying drawings, in which.

In the drawings like characters of reference indicate corresponding parts in the different figures.

DETAILED DESCRIPTION

Figure 1:
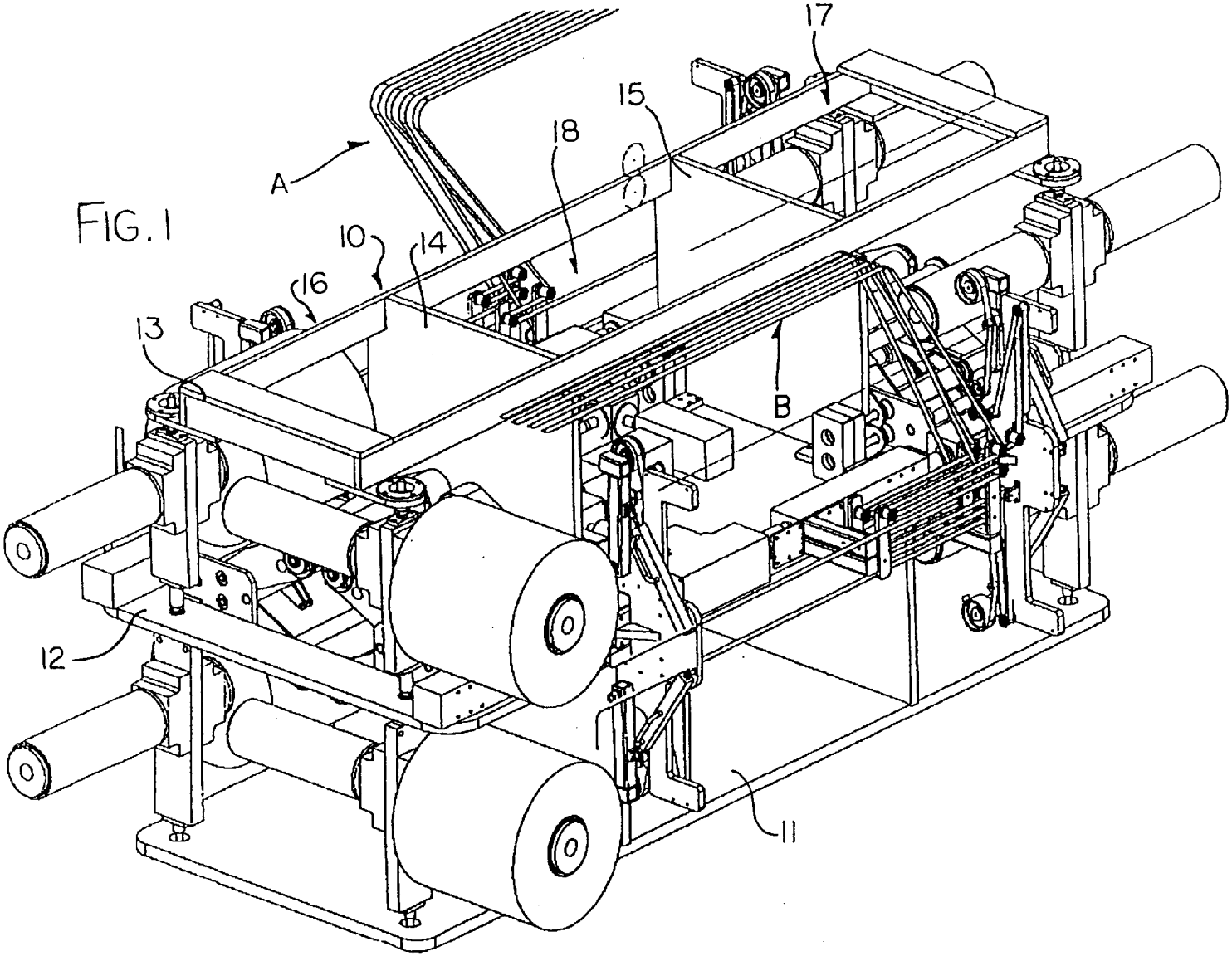
FIG. 1 is an isometric view from one side and one end of a winding apparatus according to the present invention.

The apparatus of the present invention is arranged for winding tapes slit from a master web so as to form a series of side-by side tapes of the same width each of which is arranged to be wound up into a respective cylindrical package of the tape for subsequent supply to an induce machine. The arrangement for supplying and controlling the web together with the slitting of the web is not shown since this is well known to one skilled in the art. The module shown in the figures is arranged to receive eight of the tapes from the web and to provide eight winding positions for those eight tapes. It will of course be appreciated that additional modules can be provided located adjacent to but spaced from the module shown for winding others of the tapes up to the total number of tapes available from the web. The module is supplied with two sets of four tapes as indicated at A and B respectively and provides winding positions for winding those two sets of four tapes.

The module shown in the drawings comprises a frame 10 having a horizontal base plate 11, a horizontal central frame section 12 and a horizontal upper frame section 13. The frame sections 12 and 13 are connected to the base 11 by vertical panels 14 and 15 located at spaced positions along the length of the frame sections and spaced from the ends of the frame sections. The ends of the frame sections stand in common vertical end planes of the frame parallel to the vertical plates 14 and 15 so as to define two end winding sections 16 and 17 and a central drive section 18 between the two end winding sections. The drive section 18 contains the drive components as defined and explained hereinafter and the end section 16 and 17 contain the winding components.

The frame 10 is divided into an upper row and a lower row by the central frame section 12. The upper row thus contains 4 winding positions for forming packages of the four tapes A at the four corners of the upper row as defined by the central frame section 12 and the upper frame section 13. Symmetrically, the lower row contains four winding stations again at the four corners of the frame structure directly aligned with an underlying the winding stations of the upper row.

The winding stations are symmetrical and include the same components so that only one of the winding stations will be described herein after and it will be appreciated that each of the other winding stations is substantially identical. It will be noted further that the winding stations of the bottom row are inverted relative to the winding stations of the upper row and the winding stations of the upper row are associated with the winding stations of the lower row in associated pairs.

Figure 2:
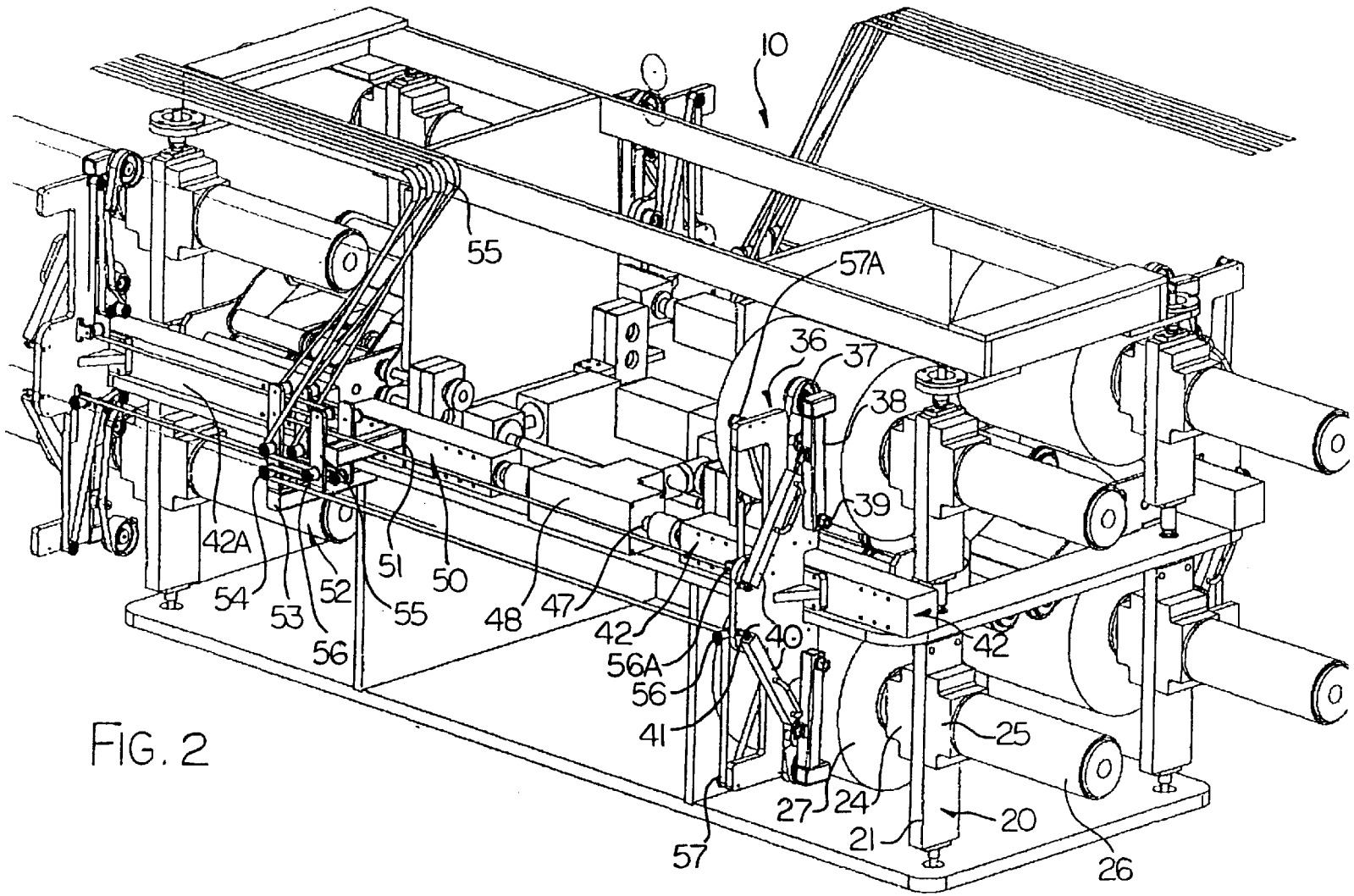
FIG. 2 is an isometric view from the other side and the other end of the winding apparatus of FIG. 1.
Figure 3:
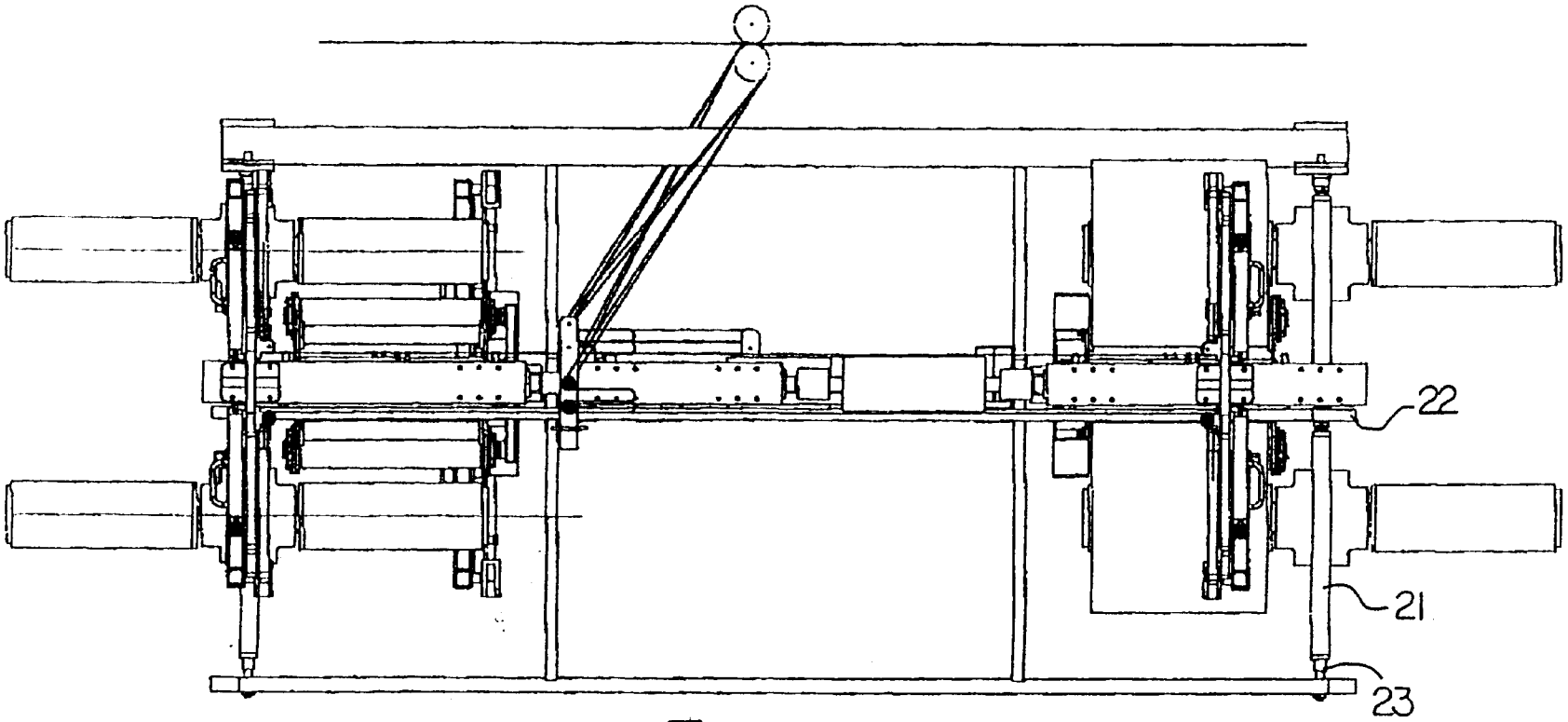
FIG. 3 is a side elevational view of the winding apparatus of FIG. 1.

Turning therefore to the structure at one winding station, the winding station comprises a drive head 20 in the form of a vertical post 21 carried on bearings 22 and 23 at its upper end and lower end respectively so that the post is rotatable about a vertical central axis of the post through 180 degrees from a first position to a second position and through a further 180 degrees back to the first position. The post has the height equal to the height of the row of winding stations so that the post is associated with a respective one of the winding positions. The post carries two support hubs 24 and 25 each carrying a cantilevered support member projecting horizontally from the post for supporting a core 26 on which a package can be wound to form a packages structure 27 on the core. The hubs 24 and 25 are arranged on opposite sides of the posts and part way up the height of the posts so that the core when mounted on the support projects horizontally. In the first position of the post, the core on the hub 24 projects inwardly into the frame into the winding position between the end of the frame and the next adjacent vertical plate. In this position the core on the hub 25 projects outwardly beyond the end frame in a doffing position. It will be appreciated that when the post is rotated through 180 degrees, the core projecting outwardly beyond the end of the frame in the doffing position as indicated at 26 in FIG. 2 is moved into the winding position and a completed package within the winding position is rotated to the doffing position for removal of the completed package and replacement by a fresh core.

Figure 5:
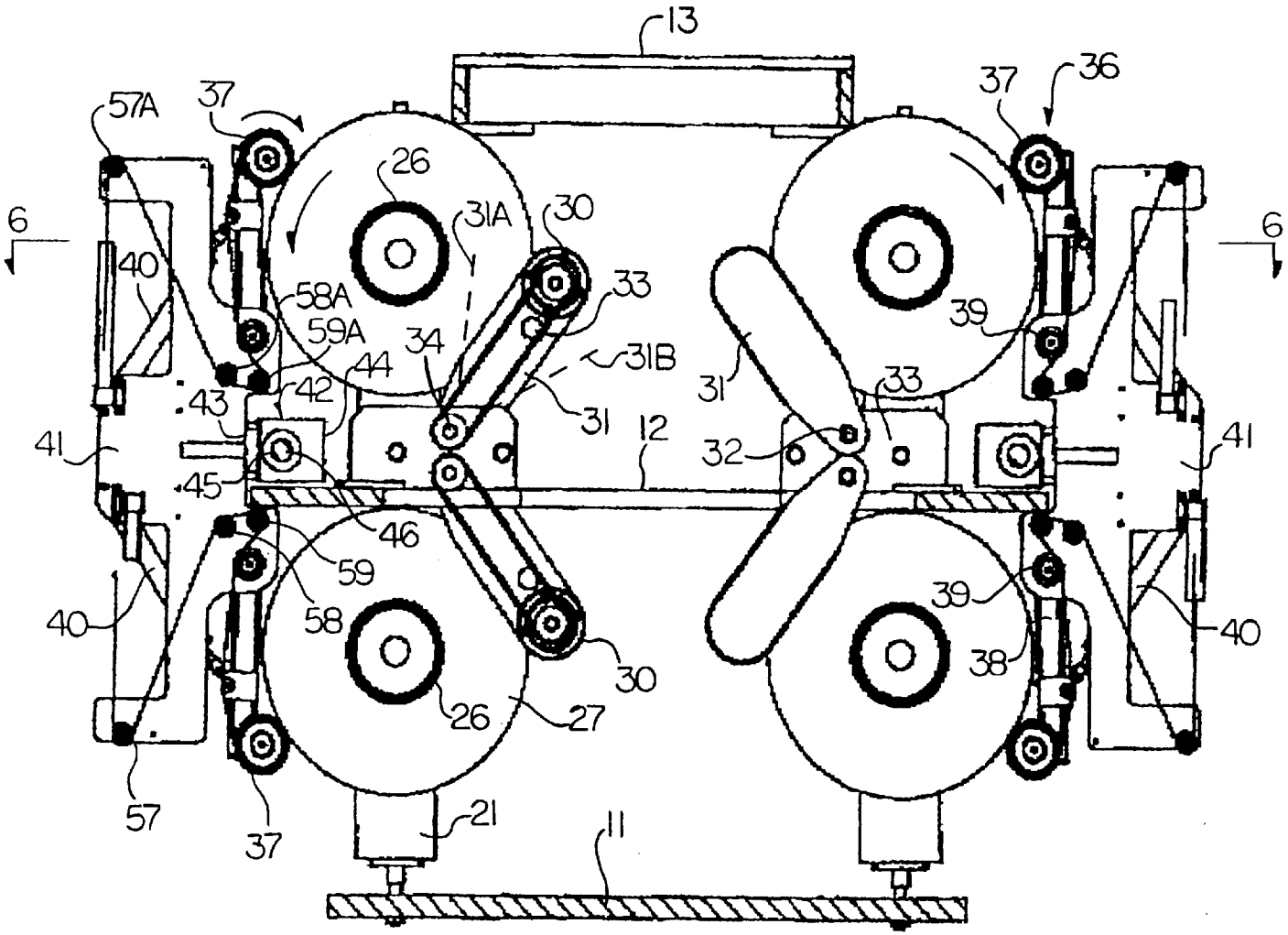
FIG. 5 is a cross sectional view along the lines 5—5 of FIG. 4.
Figure 6:
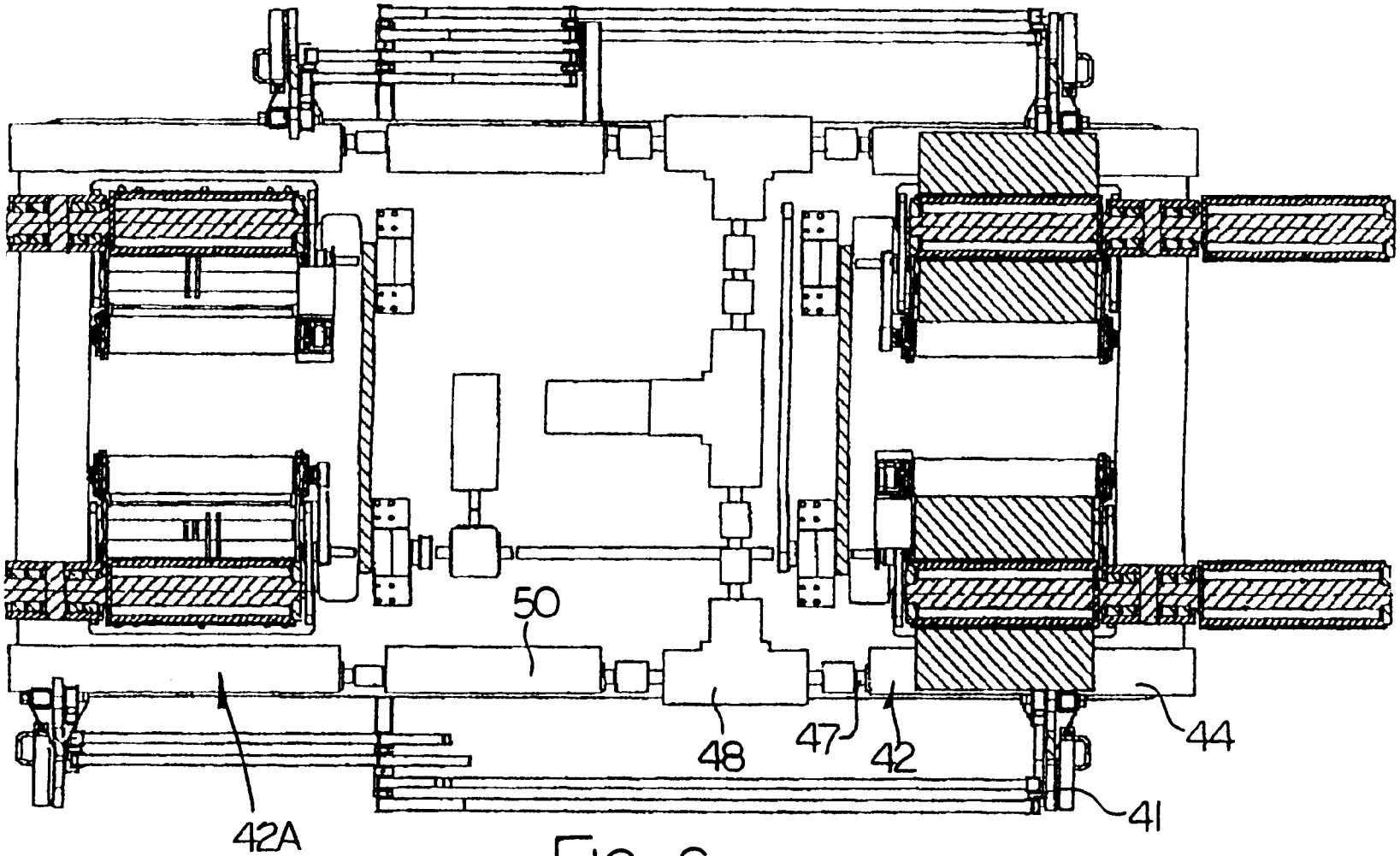
FIG. 6 is a cross sectional view along the lines 6—6 of FIG. 5.

As best shown in FIG. 5, the package when supported in the winding position by the post 21 is contracted by a drive roller 30 which engages the outside cylindrical surface of the package for rotating the package in a winding direction about the axis of the respective hub 24, 25. The drive roller 30 is mounted on a swing arm 31 so that it can pivot about a pivot shaft 32 carried on a support base 33 attached to the central frame section 12. Thus as the package grows, the arm 31 moves from an initial position schematically indicated at 31A where the drive roller 30 is in contact with the core 26 through a driving position as the package 27 increases in diameter to a retracted position 31 B when the packages reaches its maximum size.

The roller is carried in two parallel support arms each at a respective end of the package and the roller is driven by a belt 33 located within or at one of the support arms 31. The belt 33 is driven by a pulley 34 on a shaft 35. The shafts 35 of each of the winding stations are driven at a common driving speed which is calculated to provide an angular velocity of the drive roller 30 which is equal to the forwarding speed of the tapes to be wound. Provided that a spring pressure biasing the roller into engagement with the package is sufficient to ensure that there is no slippage between the outside surface of the package and the outside surface of the roller, driving the roller at the predetermined constant speed provides a winding of the tape at a speed equal to the forwarding speed so as to maintain a constant tension on the tape. The drive speed of the shaft 35 can be controlled by an operator control system (not shown) so as to provide slight variations to control winding tension and so as to vary speed in dependence upon the feed speed of the tape to be wound, should this vary.

As previously stated the winding positions in the top and bottom rows are symmetrical but inverted so that the drive roller 30 of the top row is mounted on the base 33 and projects upwardly and rearwardly into the interior of the frame and also the roller 30 of the lower row extends rearwardly into the interior of the frame but also downwardly from the mounting base 33.

The tape to be wound into the package structure is applied to the package structure by a guide 36 which carries the tape in a tape path over the guide so as to be laid onto the package surface. The guide comprises a roller 37 mounted for rotation about an axis parallel to the axis of rotation of the package so that the tape passes over the top of the roller which rotates in a direction opposite to the direction of rotation of the package thus directly laying the material onto the package as the package and the lay-on roller rotate. The lay-on roller is an idler roller driven by the rotation of the package.

In addition the guide 36 defined by the idler roller 37 is moved horizontally in a traversing action so that the position of the lay-on roller on the package moves axially of the package from one end face of the package to an opposed end face of the package thus forming the package into a cylindrical structure with vertical circular ends. The traversing movement is relatively slow so that at the tape is moved for each rotation of the package by a distance of the order of the width of the tape, which can be less than the width of the tape or approximately equal to the width of the tape so the tape is carefully laid onto the package at a shallow angle with each tape turn overlapping with or lying adjacent to the previous tape turn.

In addition to the rotational movement of the lay-on roller to apply the tape onto the package and in addition to the axial movement of the lay-on roller for providing the traversing action, it is also necessary for the lay-on roller to pivot away from the package as the diameter of the package increases from the initial diameter of the core up to the completed diameter of a filled package.

The lay-on roller is thus mounted on a pivot arm 38 pivotally mounted about a shaft 39 and spring-biased toward the package by a spring actuator 40.

The lay-on roller and its pivot arm 38 are mounted on the front side of the package that is the side opposite to the interior of the frame and opposite to the drive roller 30. Thus the lay-on roller and its drive system are positioned at the front of the frame exposed for inserting of the tape and for servicing as required. As previously described, the winding position of the bottom row is inverted relative to the winding position of the top row so that the pivot arm of the top row is mounted on a pivot shaft 39 at the bottom of the pivot arm with the roller 37 approximately at the two o'clock position on the package. In the symmetrical position of the bottom row, the lay-on roller is arranged at the 4 o'clock position of the package and the pivot shaft 39 is above the lay-on roller.

The lay-on rollers and their associated supporting pivot shaft are mounted on a common support plate 41 which stands vertically at the winding position and carries the guide rollers for the threading of the tape, the lay-on roller and the respective support arm of the biasing spring 40 which extends from the pivot arm outwardly toward the front of the frame and from the pivot arm toward the pivot axis of the pivot arm. The support plate 41 carrying both the lay-on rollers 37 for the upper package and the lower package is driven in a horizontal traversing movement by a drive mechanism 42. The support plate 41 is mounted on a horizontal drive plate 43 which slides back and forth across the front of a support housing 44. The plate 43 attaches to a nut 45 which is driven in the reciprocating movement by a lead screw 46 carried on a shaft 47 driven by a gear box 48. The shaft 47 provides a common drive for all of the four packages on one side of the frame since the shaft 47 extends across from the drive mechanism 42 of the pair of upper and lower packages at one end to a drive mechanism 42A for the packages at the other end. The support plate 41 is movable back and forth across the width of the package in a traversing action so as to build the structure of the package. In addition at the end of the build of a package, the lead screw can be rotated to carry the support plate 41 to a position beyond the inner end of the package that is to the end of the package away from the support post 21 where it is temporarily halted by halting the movement of the shaft 47 and therefore the lead screw. It will be appreciated that in order to achieve this movement, the lead screw in the drive mechanism 42A is arranged opposite to the lead screw in the drive mechanism 42 so that the support plates and lay-on rollers carried thereby for the two sets of packages move in the opposite directions during the winding process and during the movement to the parked position beyond one end of the package.

The drive shaft 47 drive a further drive mechanism 50 in between the gear box 48 and the drive mechanism 42A. The drive mechanism 50 further includes a lead screw which drives a nut carrying a support plate 51 which again is moved by and forth in reciprocating action but over a distance which is one half of the distance of movement of the support plates 41. Thus the lead screw of the mechanism 50 has a pitch which is one half of the pitch of the lead screws of the drive mechanisms 42A and 42. The drive mechanism 50 drives a path length compensation system schematically indicated at 52 carried on a support plate 51. The path length compensation system 52 includes a fixed support 53 which remains stationary and carries a plurality of tape guide rollers 54 over which the tapes pass from a stationary supply roller 55. Thus the tapes move in a constant fixed path from the supply 55 through to the rollers 54 on the fixed support 53. The plate 51 carries a second support 55 which is carried horizontally on the drive mechanism 50. The movable support 55 carries a further plurality of rollers 56 around which the tape is passed. The tape then passes from the roller 56 back to another roller on the fixed stand 53 thus forming two portions of tape path from the stationary stand to the reciprocating stand and back to the stationary stand where the two portions are simultaneously increased in length as the movable stand moves away from the fixed stand. The drive mechanism 50 is driven of course in synchronism with the drive mechanisms 42 and 42A in a reciprocating action so that as the two sets of lay-on rollers move in their traversing action away from the fixed stand thus increasing the path length from the fixed stand to the lay-on rollers, the movable stand of the length compensation system moves toward the fixed stand thus reducing the path length between the fixed stand and the movable stand to maintain the total tape path from the fixed supply 55 through to the lay-on roller at a constant distance and thus maintain the tape tension approximately constant.

It will be noted that the fixed stand and the movable stand provide rollers having their axes at right angles to the side of the frame and thus parallel to the axis of the roller 55 so that the tape remains with its width lying parallel to the axis of these rollers. The tapes thus extend side by side downwardly along the side of the frame to the length compensation system and then extend from the length compensation system to the respective support plate of the lay-on rollers of the two pairs of packages. At the support plate 41, the tape passes over a roller 56 which has an axis parallel to the axes of the previous rollers in the tape path. At the roller 56 the tape turns so that it extends along the length of the support plate 41 with the tape of the lower package turning downwardly over the roller 56 and the tape of the upper package turning upwardly over the roller 36A of the symmetrical upper package arrangement. The tape from the roller 56 extends downwardly to a guide roller 57 and then extends upwardly and around to further rollers 58 and 59 to turn downwardly again to the lay-on roller 37. As the tape passes from the roller 56 to the roller 57, the tape is also twisted through 900 so that it takes up a position across the axes of the rollers 57, 58 and 59 which are parallel to the axis of the lay-on roller 37 and thus extend along the side of the frame.

Symmetrically, the tape for the upper package extends from the roller 56A to a top guide roller 57A and over bottom rollers 58A and 59A to the corresponding lay-on roller 37.

Figure 4:
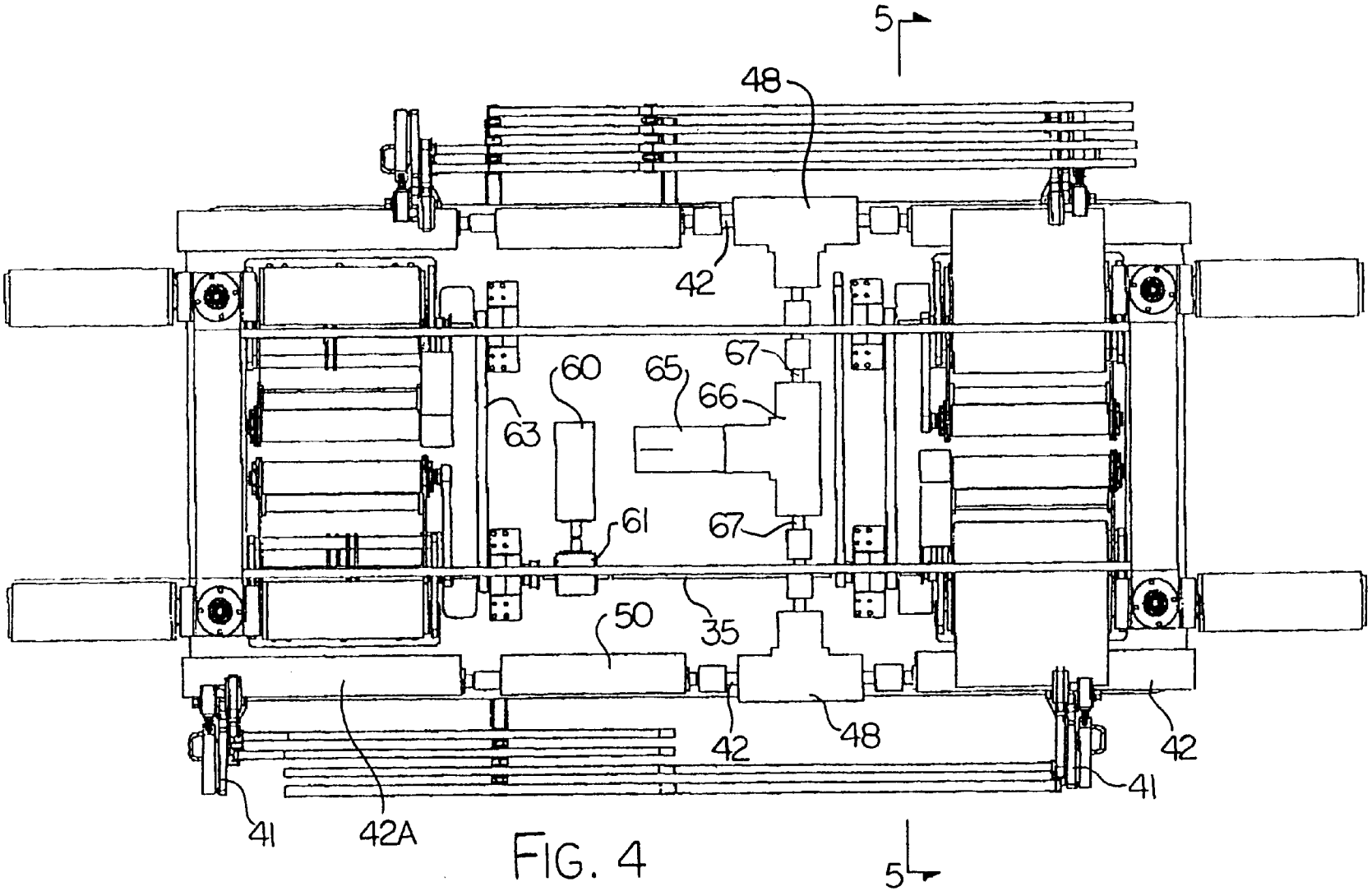
FIG. 4 is a top plan view of the winding apparatus of FIG. 1.

The rollers are all idler rollers so that the tape speed is controlled by the rotation speed of the package which is controlled by the package drive roller 30. The tape tension is therefore controlled by controlling the speed between the tape supply from up between the supply machine and the speed of the drive roller 30. As best shown in FIG. 4 the shaft 35 of each of the package drive rollers is driven from a common drive motor 60 through a gear box 61 which directly drives the shafts 35 on the one side of the machine and a chain coupling 63 which extends from the shafts 35 on one side to the shafts 35 on the other side.

Similarly the shafts 42 which act to drive the traverse movement and the length compensation mechanisms are simultaneously driven by a drive motor 65 which connects to a gear box 66 driving shafts 67 connected to the gear boxes 48.

During winding of the package, therefore, the tape is fed over the constant path length from the supply to the lay-on roller and the lay-on roller moves back and forth across the width of the package. Simultaneously the lay-on roller is pushed away by the increasing diameter of the package against spring tension so that it remains pressed against the surface of the package during the winding process. The package is driven by the package drive roller 30 so that the outside surface of the package moves at a constant speed equal to the speed of the roller 30 while the angle of velocity of the package slows as the diameter of the package increases. The roller 30 also moves away from the package to accommodate the increasing diameter of the package as the package builds from the initial position 31A to the position 31B at maximum diameter of the package. Again the spring force from the package drive roller 30 applies a constant pressure against the package surface to maintain constant frictional drive to the package.

The packages are built simultaneously up to the maximum package diameter and when this is achieved, the machine is moved into a transfer mode in which a number of steps occur. Firstly the supply of tape is halted and the tape from each lay-on roller to the respectively completed package is cut thus allowing the lay-on roller to stop.

With the lay-on roller halted, the lay-on rollers are moved to the parked position beyond the inner end of the package away from the support posts 21. The traversing movement of the lay-on rollers is temporarily halted in this path position.

The support heads 20 are rotated to carry the completed package from the winding position to the doffing position. Simultaneously this movement carries the fresh core from the doffing position to the winding position to replace the completed package. The direction of rotation of each support head is arranged so that the completed package moves outwardly from the side of the frame past the lay-on roller, which is now moved to one side, and away from the drive roller 30. Simultaneously the core passes through 180° from the doffing position into the end of the frame so that passes over the top of the drive roller 30 in its retracted position 31B. The support head thus halts at the rotated position thus holding the fresh core at the winding position. The force on the support arm 31 for the drive roller is applied through a spring cylinder system which allows a delay in the movement of the support arm 31 from the retracted position 31B up to the initial drive position 31A so the core passes over the roller 30 before it moves to the position 31A. After the core reaches its winding position, the roller 30 moves back to the position 31A allowing driving of the core to commence.

With the core rotating, the lay-on roller carrying the cut end of the tape is moved back into its traverse position to commence further traversing movement. The core carries a trapping mechanism which traps the free end of the tape so that the tape is grasped allowing winding to continue so that the feed from the feed system can be restarted.

With the completed package in its doffing position, the package can be wrapped with suitable protective material for transportation and can be removed from its support with its associated core for placement with a fresh core. The packages are presented conveniently beyond the frame at the ends of the frame so they are readily available for access by the operator. The arrangement of the modular frame having four packages at each end provides the packages at a convenient height for the operator without the necessity for climbing or excessive reaching and allowing the building of packages having a diameter in the range of the order of 6 inches to 4 feet.

In the winding position, and in order to ensure that particularly heavy packages are properly supported, a live or rotatable end can be provided supported on the vertical support plate 14, 15 which is free to rotate when it engages the end of the core but can be moved axially into the end of the core when the core reaches its winding position by rotation of the support head from the doffing position.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. Apparatus for winding an elongate material comprising:

a support for supporting in a winding position a core onto which the material is to be wound;

a drive assembly for causing rotation of the core in the driving position about a longitudinal core axis;

a guide for directing the elongate material to the core such that the rotation of the core about the axis acts to wind the material around the core;

a traverse drive for effecting relative movement longitudinally of the axis between the core and the guide such that the material is traversed longitudinally of the core as it is wound around the core to form a generally cylindrical package structure;

and a rotatable drive head for transporting the package structure from the winding position to a doffing position and simultaneously for transporting an empty core from a supply position to the winding position, the rotatable drive head being arranged for rotation about a head axis substantially at right angles to the axis of the core.

2. The apparatus according to claim 1 wherein the head axis is substantially vertical and wherein the axis of the core is substantially horizontal.

3. The apparatus according to claim 1 wherein the support is carried on the head and is cantilevered relative to the head from one end of core.

4. The apparatus according to claim 3 wherein there is provided for the core a rotatable end support member movable into engagement with the other end of the core for assisting in supporting the core during winding.

5. The apparatus according to claim 3 wherein the head comprises a post and the support comprises a pair of hubs each connected to the post for carrying the package core and the empty core respectively.

6. The apparatus according to claim 1 wherein the rotatable drive head is rotated through 180 degrees such that the doffing position and the supply position are the same position at which the package is removed and the empty core is replaced.

7. The apparatus according to claim 1 wherein the drive assembly comprises a rotatable surface drive body arranged to frictionally engage an outer surface of the package to effect driving of the package by surface drive.

8. The apparatus according to claim 7 wherein the surface drive body is mounted for movement relative to the core axis in a direction transverse to the core axis from an initial position to a retracted position to accommodate increasing diameter of the package on the core.

9. The apparatus according to claim 8 wherein the surface drive body is mounted on a pivot arm arrangement for pivotal movement about an axis parallel to the core axis.

10. The apparatus according to claim 8 wherein the surface drive body is arranged in the retracted position such that the package moves on the drive head away from the surface drive body and such that the empty core passes across the drive body into the winding position.

11. The apparatus according to claim 1 wherein the traverse drive drives the guide while the package remains at a stationary position along the core axis.

12. The apparatus according to claim 11 wherein the traverse drive drives the guide from a guide location during winding to a retracted position beyond one end of the package when the drive head moves the package such that the package moves past the guide location to the doffing position.

13. The apparatus according to claim 11 wherein guide is a lay-on roller rotatable about an axis parallel to the core axis for contacting the package during winding.

14. The apparatus according to claim 11 wherein there is provided a length compensation system for taking up changes in path length of the material caused by movement of the guide and wherein the length compensation system is positively driven in synchronism with and at a length proportional to movement of the guide.

15. The apparatus according to claim 14 wherein the length compensation system includes a fixed guide member over which the material passes and a movable guide member over which the material passes, the movable guide member being arranged to move away from and back toward the fixed guide member to generate a change in path length, the distance of movement of the movable guide member being one half of the movement of the guide.

16. The apparatus according to claim 14 wherein the guide is driven by a first lead screw parallel to the core axis and wherein the length compensation system is driven by a second lead screw parallel to the first and driven commonly with the first.

17. The apparatus according to claim 16 wherein the movable guide member is driven in a direction parallel to the core axis.

18. The apparatus according to claim 17 wherein the first and guide members comprise rollers which are rotatable about parallel axes at right angles to the core axis such that the material is turned through 90 degrees in movement from a supply to the guide.

19. The apparatus according to claim 1 wherein including a winding module having four winding positions lying in a common horizontal plane and wherein each winding position is arranged at a corner of the module such that the doffing position of each winding position is located outside the module beyond the respective corner.

20. The apparatus according to claim 19 wherein there is provided two rows of the winding positions making eight in total.

21. Apparatus for winding an elongate material comprising:

a support for supporting in a winding position a core onto which the material is to be wound;

a drive assembly for causing rotation of the core in the driving position about a longitudinal core axis;

a guide for directing the elongate material to the core such that the rotation of the core about the axis acts to wind the material around the core;

a traverse drive for effecting movement longitudinally of the axis of the guide such that the material is traversed longitudinally of the core as it is wound around the core to form a generally cylindrical package structure;

and a length compensation system for taking up changes in path length of the material caused by movement of the guide;

wherein the length compensation system is positively driven in synchronism with and at a length proportional to movement of the guide.

22. The apparatus according to claim 21 wherein the length compensation system includes a fixed guide member over which the material passes and a movable guide member over which the material passes, the movable guide member being arranged to move away from and back toward the fixed guide member to generate a change in path length, the distance of movement of the movable guide member being one half of the movement of the guide.

23. The apparatus according to claim 21 wherein the guide is driven by a first lead screw parallel to the core axis and wherein the length compensation system is driven by a second lead screw parallel to the first and driven commonly with the first.

24. The apparatus according to claim 23 wherein the movable guide member is driven in a direction parallel to the core axis.

25. The apparatus according to claim 24 wherein the first and guide members comprise rollers which are rotatable about parallel axes at right angles to the core axis such that the material is turned through 90 degrees in movement from a supply to the guide.

* * * * *